US006602331B2

(12) United States Patent
Gonzalez Alemany et al.

(10) Patent No.: US 6,602,331 B2
(45) Date of Patent: Aug. 5, 2003

(54) HANDRAIL FOR VARIABLE SPEED MOVING WALKWAY

(75) Inventors: Miguel Angel Gonzalez Alemany, Asturias (ES); Juan Domingo Gonzalez Pantiga, Asturias (ES); José Esteban Fernandez Rico, Asturias (ES); José Manuel Sierra Velasco, Asturias (ES); Ricardo Vijalde Diaz, Asturias (ES); José Casielles Estrada, Asturias (ES); Manuel Alonso Cuello, Asturias (ES)

(73) Assignee: Thyssen Norte, S.A. (ES)

( * ) Notice: Subject to any disclaimer, the term of this patent is extended or adjusted under 35 U.S.C. 154(b) by 0 days.

(21) Appl. No.: 10/265,565

(22) Filed: Oct. 4, 2002

(65) Prior Publication Data

US 2003/0066731 A1 Apr. 10, 2003

(30) Foreign Application Priority Data

Oct. 5, 2001 (ES) ..... 200102231

(51) Int. Cl.[7] ..... B66B 23/26
(52) U.S. Cl. ..... 96/66
(58) Field of Search ..... 198/337, 334, 198/335, 336, 330, 331

(56) References Cited

U.S. PATENT DOCUMENTS

| | | | | | |
|---|---|---|---|---|---|
| 2,769,522 | A | * | 11/1956 | Pfeifer | 198/334 |
| 2,979,180 | A | * | 4/1961 | Cole | 198/337 |
| 3,688,889 | A | * | 9/1972 | Koch et al. | 198/337 |
| 3,865,225 | A | * | 2/1975 | Phal | 198/337 |
| 4,232,776 | A | | 11/1980 | Dean | 198/322 |
| 5,275,270 | A | * | 1/1994 | Dobo | 198/337 |
| 6,367,608 | B1 | * | 4/2002 | Franceschi | 198/335 |

FOREIGN PATENT DOCUMENTS

| | | | |
|---|---|---|---|
| EP | 0831052 | 3/1998 | 21/12 |
| EP | 0837026 | 4/1998 | 23/26 |
| FR | 2757143 | 6/1998 | 23/24 |
| FR | 2792626 | 10/2000 | 23/26 |
| GB | 2264686 | 8/1993 | 17/34 |
| JP | 08067489 | 3/1996 | 23/26 |
| JP | 2001048457 | 2/2001 | 23/26 |

* cited by examiner

*Primary Examiner*—Christopher P. Ellis
*Assistant Examiner*—Richard Ridley
(74) *Attorney, Agent, or Firm*—Ostrolenk, Faber, Gerb & Soffen, LLP

(57) ABSTRACT

Handrail for variable speed moving walkway which comprises a flexible belt or profile which circulates over the length of the walkway, with a forward stretch and a return stretch. The profile or band is constituted on the basis of fixed length stretches and, optionally, stretches of variable length, alternating and joined to each other. The fixed length stretches have a profile which defines a toothed arrangement which meshes successively with a series of pulling chains which are arranged between the forward and return stretches of the handrail, mounted between toothed wheels and each one moves at a speed different from the adjacent chains.

24 Claims, 7 Drawing Sheets

HANDRAIL FOR VARIABLE SPEED MOVING WALKWAY

BACKGROUND OF THE INVENTION

The present invention relates to a handrail for a walkway with acceleration for conveying people or materials, which offers major improvements in user comfort and in the simplicity of its mechanism.

More specifically the handrail of the invention is of the type which comprises a system of handles which circulate over the length of the walkway, with a forward stretch and a return stretch, mounted on a drive mechanism. Diverse handrail systems are already known for variable speed walkways. For example, a system consisting of several handrails at constant speed is known, in which each handrail circulates at a speed different from the previous one, as close as possible to that of the plates that are in the same area. Handrails with this constitution are described for example in the French patent 2757143 and in the European patent n° 0837026.

Systems are also well-known that are made up of pieces or handles that circulate at the same speed as the neighboring plate. Speed variation can be achieved by means of the use of variable speed chains, such as is described in the patent GB 2264686, by means of elements linking the pieces, which employ appropriate guides to enable the speed to be varied, such as is described in the patent FR 2792626, or by means of systems of friction as is described in the U.S. Pat. No. 4,232,776.

EP 0831052 discloses a continuous variable speed handrail formed by a rubber belt with a reticular cable structure in its interior. Speed variation is achieved by deforming the rubber belt perpendicular to the movement direction.

In all cases the handrails require some relatively complicated mechanisms and the effect achieved does not always adapt to the speed of the corresponding stretch of the walkway with acceleration.

SUMMARY OF THE INVENTION

The object of the present invention is to develop a handrail for a variable speed moving walkway which is of simple constitution and which allows speeds to be obtained over the forward stretch of the handrail appropriate for or coordinated with those of the stretch of the corresponding walkway.

The handrail of the invention is characterized in that the profile or belt which forms the handrail proper is constituted on a basis of fixed and variable length stretches, alternating and linked to each other, the fixed length stretches having internally a profile which defines a toothed arrangement which meshes successively with a series of drive chains which are arranged between the forward and return stretches of the handrail and which are mounted between toothed wheels, each one of these chains moving at a speed different from the adjacent chains. The chains are driven by guides which determine transition areas of the fixed length stretches between two consecutive chains of different speed.

In another possible configuration, the handrail would be constituted by a great many fixed length stretches, separated from each other by variable distances as a function of the area of the walkway in which they are located, and having on their lower part a profile identical to that described previously.

The adjacent toothed wheels of each two consecutive chains have a different diameter and a different number of teeth and are mounted on a same axle, the two wheels abutting against each other, so that the corresponding chains run on close and parallel planes. This constitution allows the use in the whole system of a single drive shaft which will transmit the movement to the remaining chains, in a coordinated manner, the increase or decrease of speed thereof taking place according to the tooth ratio between two consecutive wheels.

The aforementioned guides run immediately inside the flexible belt or profile which forms the handrail and define, at least in the transition area, two parallel longitudinal paths, through each of which circulates one of the chains which converge on said area, between which penetrates the toothed profile of the fixed length stretches of the handrail.

In the transition areas means can also be mounted for pushing on the fixed length stretches which produce a speed variation of said stretches in the same direction as the movement in said area.

In the area where the user boards, the fixed pieces are meshed in a chain running at slow speed, approximately equal to the speed of the system for moving people on the walkway in that area. The meshing takes place between two points of the fixed length stretches and two points of the chain. In a preferred configuration, each fixed length stretch would have a rack type profile with two valleys, meshed with two elements of revolution located on two articulations of the chain.

In the area of acceleration, each fixed length stretch is meshed with different chains each of which circulates at a greater speed than the previous one. Thus, each fixed length stretch maintains a speed close to the speed of the system for moving people in said area. The transition of each fixed length stretch between two consecutive chains is carried out in the following way:

Initially each fixed length stretch comes meshed in two articulations of one chain as was described previously. The element of the chain which is in the first articulation disengages from the fixed length stretch by the use of some appropriate guides for the chain. This allows the higher speed chain to mesh in the hole that the first articulation of the lower speed chain has left free. Simultaneously, and due to the configuration of the guides of each chain, the second articulation of the lower speed chain disengages from the fixed length stretch. Finally, the second articulation of the higher speed chain meshes in the hole that the second articulation of the lower speed chain has left free. The design of the rack of each fixed length stretch, and the relative position of the chains, guaranteed by the guides thereof, allows these meshing actions to be carried out such that a fixed length stretch is never loose, nor is it jammed due to the different speeds of the chains.

In the preferred configuration, the movement of the higher speed chain is transmitted to the lower speed chain on an axle close to where the transition is performed, which has two toothed wheels with a different number of teeth.

The transitions of the fixed length stretches between the different chains are carried out in an improved manner by using two variable speed conjugate profiles; one belonging to the fixed length stretch, and the other belonging to a special toothed wheel which rotates with the shaft that moves the two aforementioned chains. Thus the speed variation is smoother, improving user comfort and the life of the elements.

This same effect can be achieved with other systems; for example, by using a cam and a pusher that are synchronized with the movement of the chains. This transition described above is repeated as often as is necessary to increase the speed until maximum speed is reached.

In the area of maximum speed, each fixed length stretch meshes with a maximum speed chain.

The deceleration takes place in the same way as that described previously for the acceleration, although on this occasion, the chain which leaves the fixed length stretch is that of higher speed, and the chain that meshes is that of lower speed.

In the exit area, the handrail fixed length stretches circulate at slow speed, meshed with a slow speed chain, close to the speed of the system for moving people in that area. The turn-around is also produced of the fixed length stretches, starting the return path, which is carried out in the same way as that described for the working part; namely, first accelerating, circulating afterwards at maximum speed, and finally decelerating, to turn around once again and recommence the cycle described previously.

In the configuration with extendable elements, these adapt their length in each area as a function of the relative position of the two consecutive fixed length stretches to which there are joined.

In the configuration without extendable elements, there is a profile on which the handles in the working part slide. This profile is such that it allows the size of the slot connecting the handle with the mechanisms to be diminished, avoiding the users being pinched.

Also, it prevents the objects the user is carrying from catching on the handles. Ideally, this profile prevents the user from seeing the slot. Configurations are possible also with more than one slot, and with slots visible. These slots can be covered with some brushes or a rubber profile.

In this last configuration, the handle in its visible area is of very reduced thickness. This is possible because its strength is achieved due to the aforementioned guide profile. This reduced thickness allows the slot of the safety mechanism of the areas in which the handles are inserted in the hidden part of the machine, to be very small. In the preferred configuration, the guide profile on which the handles run will have its surface slotted. The handle will have some ribs in the form of pins that are inserted in said slots, and in this way pinching is avoided.

With the system described in the present invention, major benefits are obtained:

There are no transitions between handrails, whereby user safety is increased.

The speed variation is obtained with simple mechanisms.

All the characteristics of the invention, such as are to be found in the claims, are explained hereunder in greater detail, based on the attached drawings, wherein an example of embodiment is shown in a non-restrictive manner. In the drawings:

DESCRIPTION OF PREFERRED EMBODIMENTS

Figure 1:
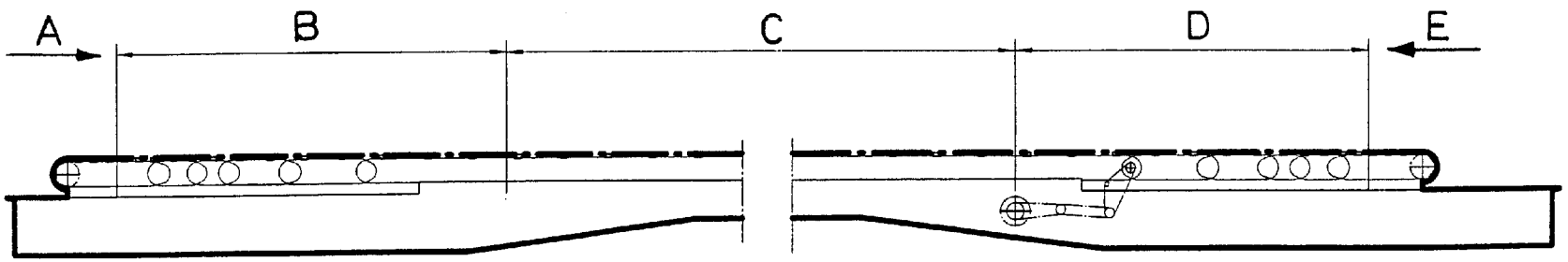
FIG. 1. It is a schematic in which the different areas of a walkway of acceleration are shown.

In FIG. 1 a complete side view is seen of a walkway of acceleration containing the handrail system of the present invention. The walkway of acceleration consists of 5 areas: area A of boarding at slow speed; area B of acceleration, area C of maximum speed, area D of deceleration, and area E of exit at slow speed.

Figure 2:
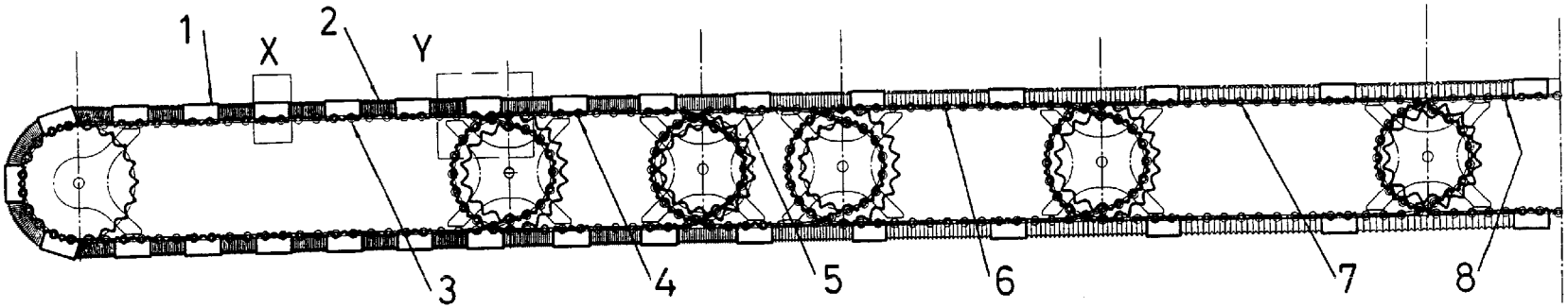
FIG. 2. It is a schematic side view of a variable speed handrail in the area of acceleration.

In FIG. 2 a handrail system for this walkway of acceleration is seen in more detail. The handrail is made up of a great number of fixed length stretches (1) or handles, and by some extendable elements (2) inserted between the fixed length stretches (1), which can be some bellows in the preferred configuration. Other configurations are possible without extendable elements (2), as will be described with reference to FIGS. 9 and 10.

Figure 5:
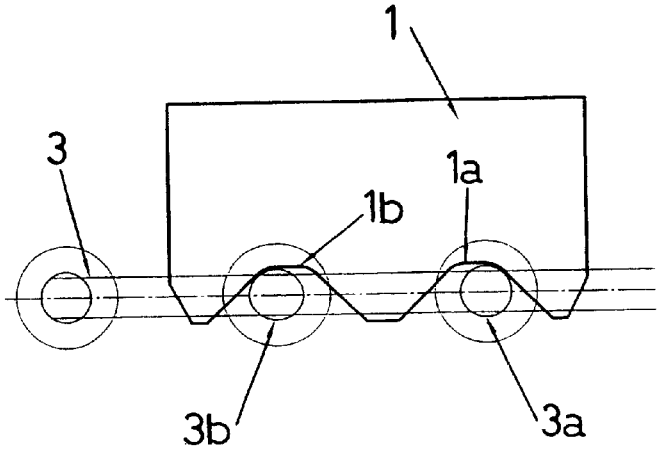
FIG. 5. It is a schematic detail of a piece of handrail meshed in one of the chains.

In the boarding area, the fixed length stretches (1) mesh with a slow speed chain (3). In FIG. 5 it is possible to see in more detail how this meshing takes place. The fixed length stretches (1) have a rack profile with two valleys **(1*a* and 1*b*). In these two valleys two elements (3*a* and 3*b*) engage, which preferably are in 2 articulations of the chain (3), although the only condition necessary is that both elements are firmly joined to the chain. This chain (3) on moving, pulls the fixed length stretches (1); whilst the fixed pieces (1) pull the extendable elements (2)**. In this way the movement of the handrail is produced in the slow speed area.

In the area of acceleration the transition takes place progressively of the fixed length stretches (1) from the slow speed chain (3) to the following chain (4) which runs at a slightly higher speed; and from the latter to the successive ones, until the maximum speed chain (8) is reached. In FIG. 2 an example is shown with 5 transitions in the acceleration, although this logically depends on the speed ratio it is desired to achieve.

Figure 4:
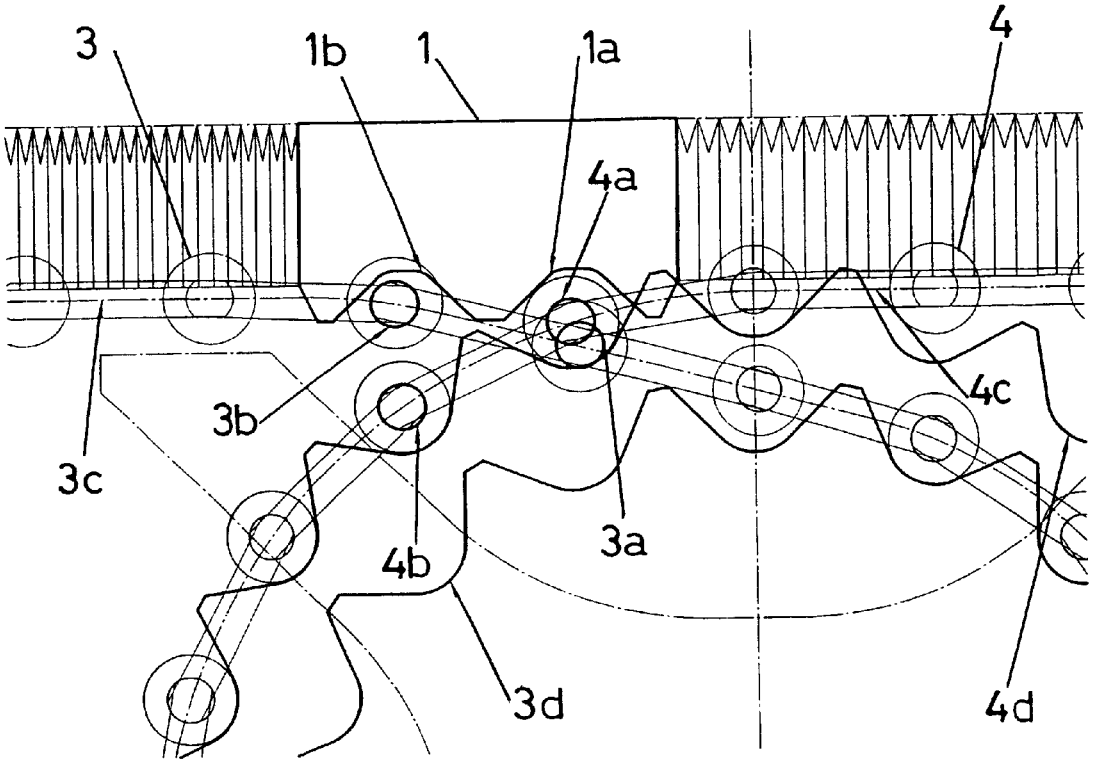
FIG. 4. It is a schematic side view of the transition of a fixed piece between two chains.
Figure 7:
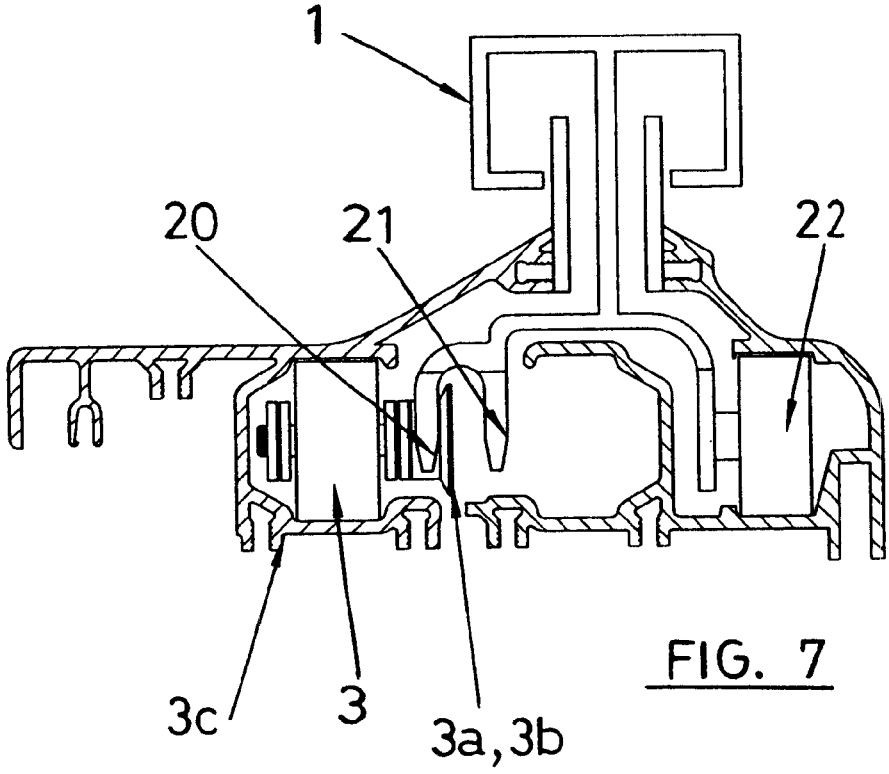
FIG. 7. It is a cross-section of the handrails in the slow speed area, in which can be appreciated the system of guidance and meshing of the fixed length blocks with the slow speed chain.
Figure 8:
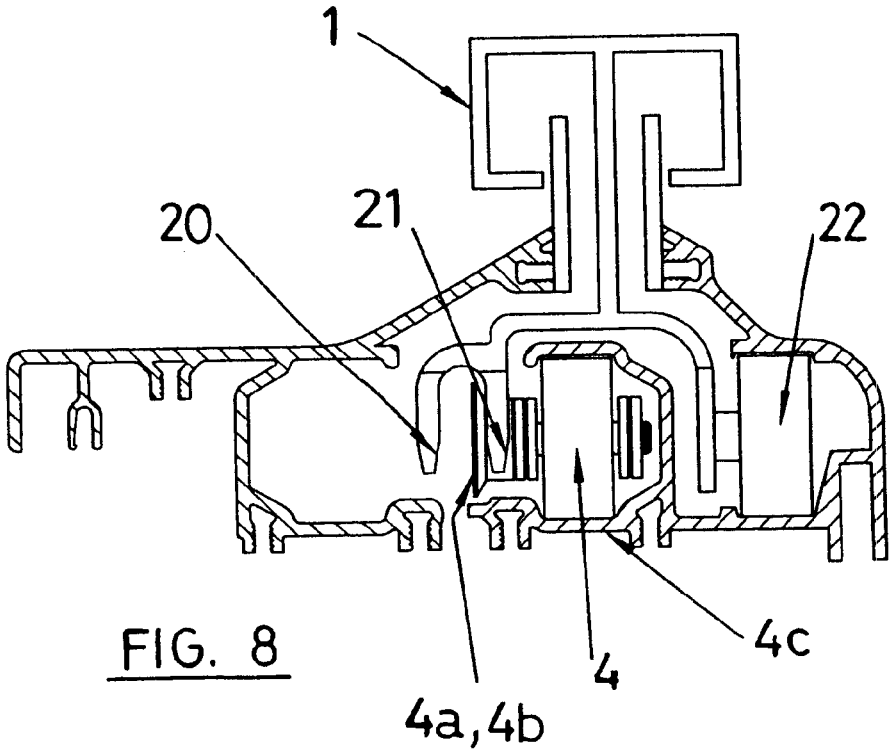
FIG. 8. It is a cross-section of the handrails in an intermediate speed area, in which can be appreciated the system of guidance and meshing of the fixed length blocks with the intermediate speed chain.

With greater detail, a fixed length stretch (1) can be seen in FIGS. 4, 7 and 8 making the transition between chains (3) and (4). Due to the arrangement of the guides **(3*c*) of the lower speed chain (3) and the guides (4*c*) of the higher speed chain (4), and to the relative position of both chains (3 and 4), disengaging of each fixed length stretch (1) is achieved from chain (3) in order to mesh it with chain (4). The process evolves in the following manner: in the first place, the front hook (3*a*) of the slow speed chain (3) leaves the first valley (1*a*) of the fixed length stretch (1). Subsequently, the leading hook (4*a*) of the high speed chain (4) occupies this first valley (1) of the fixed length stretch (3). Simultaneously, the second hook (3*b*) of the slow speed chain (3) leaves the second valley (1*b*) of the fixed length stretch (1). Finally, the followed hook (4*b*) of the high speed chain (4) occupies the second valley (1***b*) of the fixed length stretch, the fixed piece (1) becoming that pulled by the high speed chain (4). This process is repeated in the transition from chain (4) to chain (5), from this to chain (6), and so forth.

The speed ratio between chain (3) and chain (4) is achieved using a common axle (16) with 2 pinions (3*d* and 4*d*) of different diameter and number of teeth.

Figure 6:
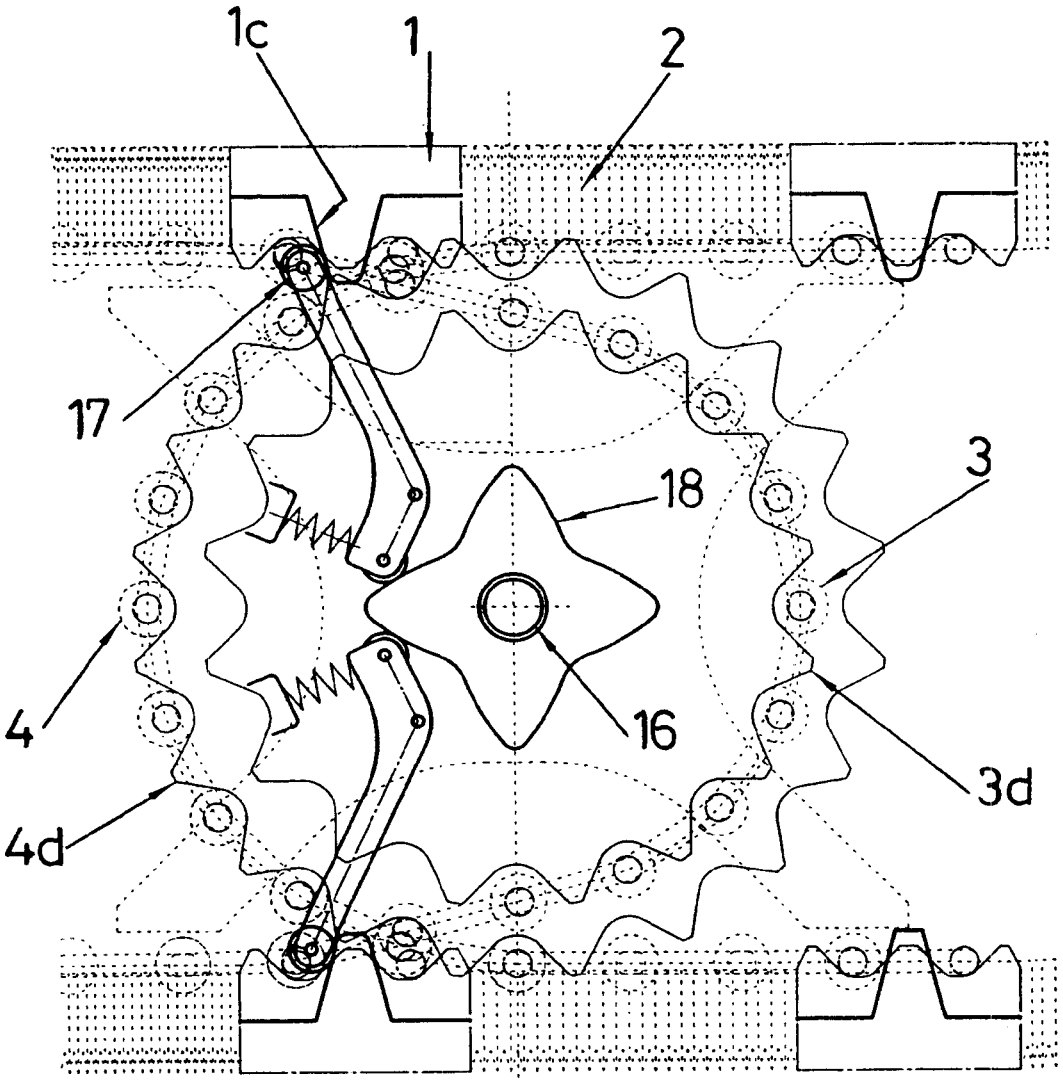
FIG. 6. It is a schematic side view of a cam type system for improving the transition of the fixed piece between two chains.

To get greater smoothness in the transition, use can be made of a variable speed gear arrangement, or a cam type system like that described in FIG. 6. Thus, each handrail fixed length stretch (1) has a profile (1*c*) which is pushed by the lever (17), articulated on the support of wheels 3*d* and 4*d*, and which in turn is moved by the cam (18), a gradual acceleration taking place in this way from the speed of the slow chain (3) to the speed of the fast chain (4). This cam (18) is moved by the same axle (16) of the pinions (3*d* and 4*d*), whereby synchronization of the movements is guaranteed. Of course, other solutions could also be used to transmit the movement to the cam (16), which would allow the design thereof to be altered.

Other possible solutions exist to smooth the transition. One of them is to give elastic properties to the extendable element (2), so that the difference in length between two consecutive expandable elements, in areas of different speed produces a force on the fixed length stretches (1) in the transition areas, which allows the speed of the fixed length stretches (1) to be adapted to that of the chain that will engage thereon.

The remaining transitions are carried out in an identical manner, whereby each fixed length segment (1) arrives at the area of maximum speed. Here, it is the chain (8) which moves the fixed length stretches (1) by the same procedure as described in FIG. 5.

Figure 3:
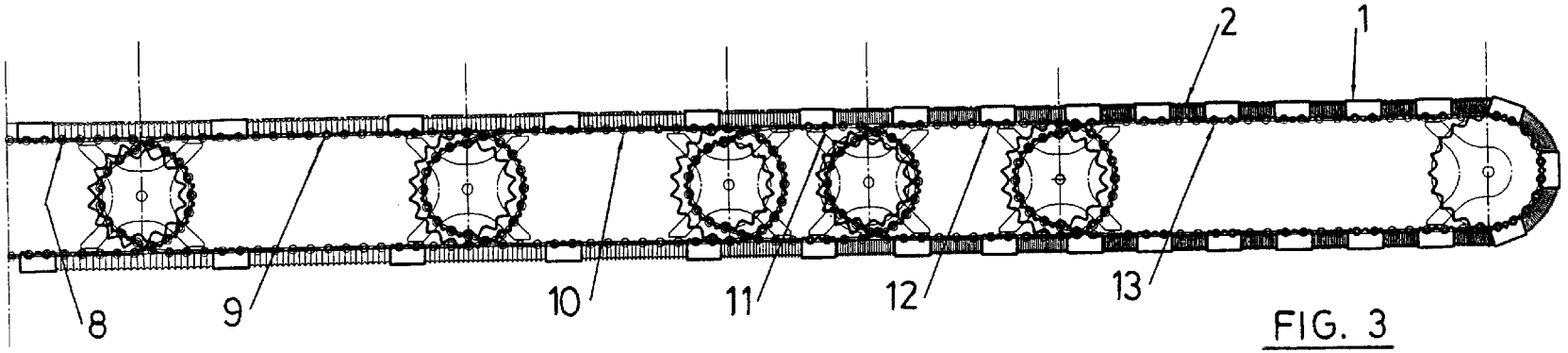
FIG. 3—It is a schematic side view of a variable speed handrail in the area of acceleration.

When the area of maximum speed has finished, each fixed length stretch (1) begins a series of transitions again, reducing the speed in each one thereof, as can be seen in FIG. 3. The transitions are carried out in the same way as has been described previously in the acceleration, although in this case the higher speed chains are abandoned in order to mesh with the lower speed chains.

Lastly, in the exit area, each handrail fixed length stretch (1) meshes with the slow speed chain (13), turns around in the final part of the walkway, and returns, repeating the same process as has been described previously for the working part.

As can be appreciated in FIGS. 7 and 8, the aforementioned guides run immediately inside the profile or belt which constitutes the handrail and defines, at least in the transition areas, two parallel longitudinal paths (3*c* and 4*c*), through each of which one of the chains circulates (3 and 4) which converge in this area. Between these two chains penetrates the toothed profile of the fixed length stretches (1), which has two walls {20 and 21) which form a like number of identical, parallel and coincident toothed arrangements, meshing the elements (3*a* and 3*b*) of the chain (3) with the toothed arrangement (20), whilst the elements (4*a* and 4*b*) of the chain (4) will mesh with toothed arrangement 21.

For greater stability of the system, the fixed length elements (1) can also have sheaves or roller elements (22) which will run on the interior of the profile which forms the guide, as is shown in FIGS. 7 and 8.

Figure 9:
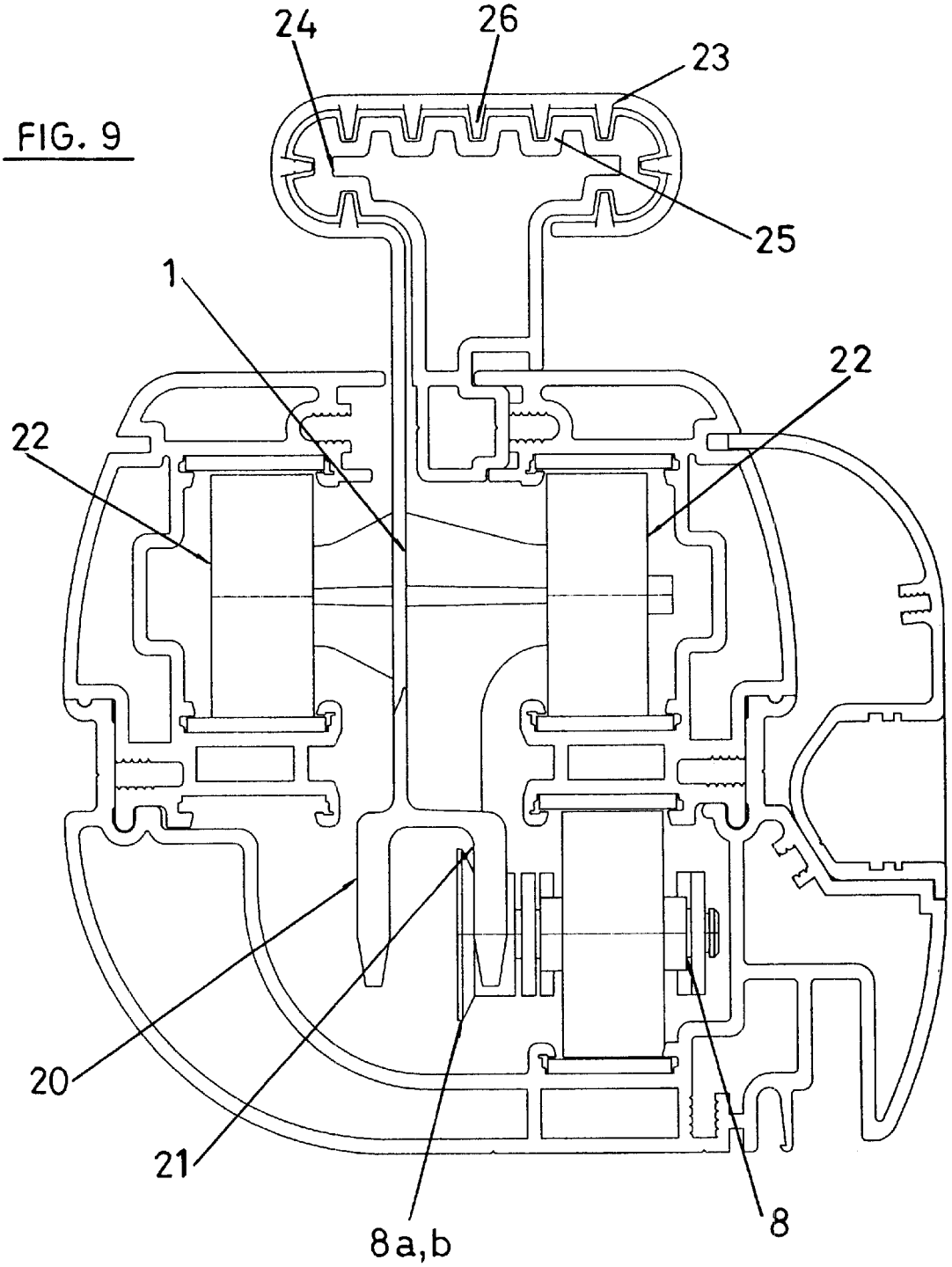
FIG. 9. It is a cross-section of the handrail with another possible configuration in which the bellows are not necessary, circulating in the area of maximum speed.
Figure 10:
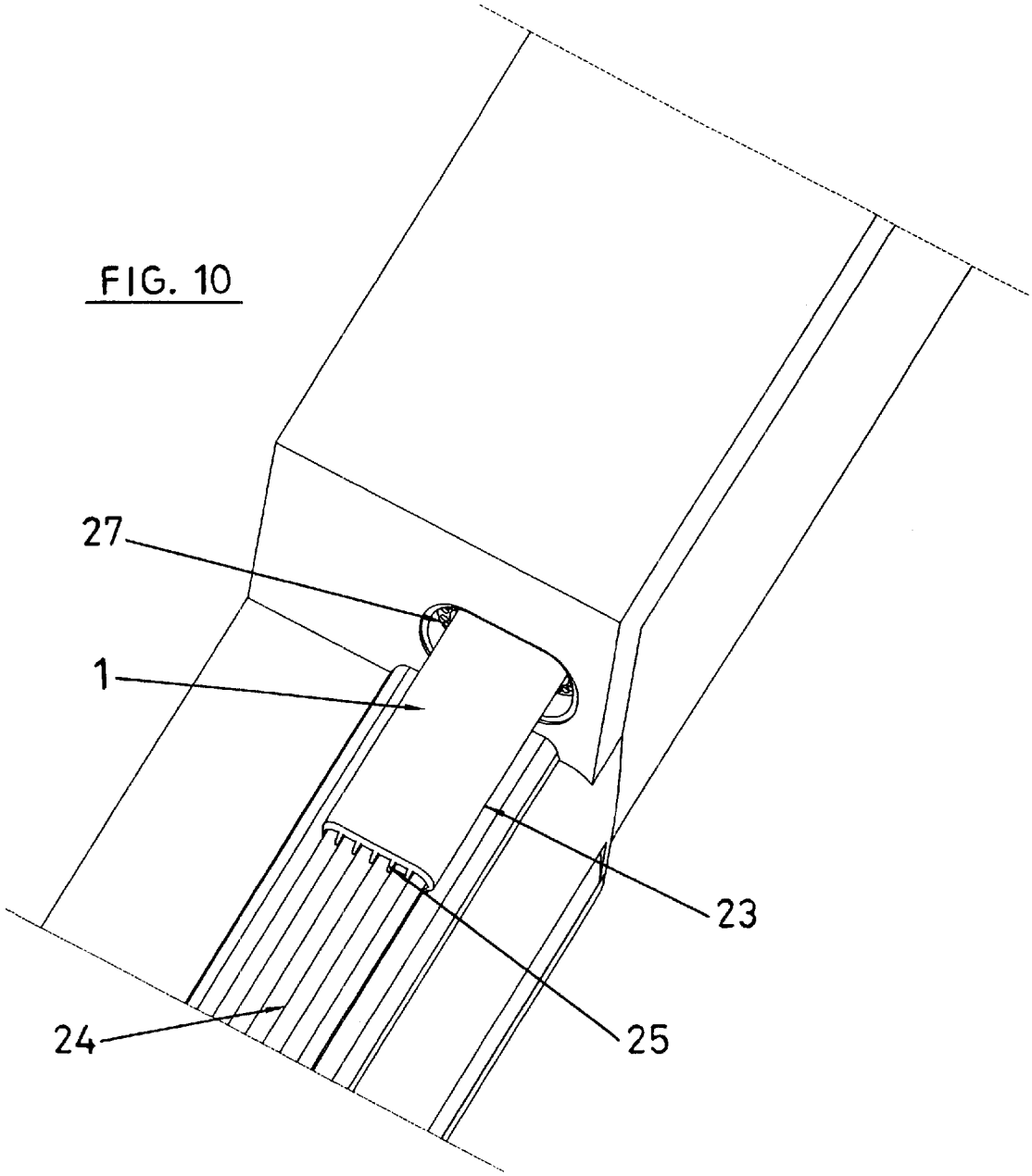
FIG. 10. It is a detail of the handrails of this last configuration in the area of the safety mechanism of the handrail entrance.

In FIGS. 9 and 10, a possible handrail configuration is described constituted only by fixed length stretches (1). In FIG. 9 a possible definition of said handle (1) can be seen, constituted by two equal parallel and coincident toothed profiles (20 and 21), by some rolling elements (22), two in this case, and by the handle (23) itself, which slides in a profile (24) complementary to the handle (23). The profile (24) has a form such that the entrance slot of the handle (23) toward the area of mechanisms is hidden for the user. Also, the profile (24) has some longitudinal slots (25) complementary to the pins (26) present in the handle (23). Thus they decrease the risk of becoming trapped. Evidently other configurations are possible: for example, without pins (25); with more entrance slots of handles {23) to the area of the mechanism; with brushes or protective rubber in said slots, etc.

In FIG. 9, the fixed length stretch (1) circulates in the maximum speed area, and the toothed profile (21) meshes with elements (8*a* and 8*b*) of the maximum speed chain (8).

FIG. 10 is a detail of the handrail according to the configuration described in FIG. 9, in which a fixed length stretch (1) is observed entering the hidden area of the mechanism. As can be appreciated, the configuration proposed allows a safety system (27) to be implemented in a very small slot with respect to the handle (23).

What is claimed is:

1. A moving hand rail of variable speed for use with a moving walkway, the handrail comprising:

a profile or a flexible belt with a lengthwise direction and a forward moving stretch; the profile or belt is continuous and is comprised of a plurality of independent stretches of fixed length, and each fixed length stretch having an engageable drive arrangement;

a drive mechanism comprising a plurality of driving elements, with the driving elements arranged in succession along a direction of movement of the forward stretch, the drive mechanism driving each of the driving elements to move in the direction of movement at a respective speed, wherein the speed of at least one of the driving elements is different from the speed of other ones of the driving elements in succession, each of the driving elements being guided around a respective pair of wheels spaced apart along in the direction of the forward moving stretch;

guides for the driving elements disposed between successive driving elements in the direction of movement, at each guide a fixed length stretch departs one of the driving elements and is engaged by the succeeding driving element, whereby the fixed length stretch leaves moving at the speed of the preceding driving element and thereafter moves at the speed of the succeeding driving element and, each driving element being positioned by the respective pair of wheels to engage the drive arrangements of the respective fixed length stretches then moving over the driving element, whereby the fixed length stretches move at the speed of the respective driving element then engaging the respective fixed length stretches of the belt or profile.

2. The handrail of claim 1, wherein the profile or belt also has a return moving stretch opposed to, spaced from and moving in the opposite direction from the forward moving stretch; and the wheels moving the driving elements being disposed between the forward and return moving stretches of the handrail.

3. The handrail of claim 1, wherein each driving element comprises a chain and the drive arrangement of each fixed length stretch comprises a tooth arrangement for being engaged by the chain then passing the fixed length stretch.

4. The handrail of claim 3, wherein the wheels guiding each chain are toothed wheels.

5. The handrail of claim 1, further comprising variable length stretches disposed between successive fixed length stretches of the handrail; wherein the fixed and variable length stretches alternate along the handrail; adjacent stretches are joined to each other; wherein the handrail is a continuous unbroken structure adapted to the speed changes in the fixed length stretches caused by the respective driving elements.

6. The handrail of claim 5, wherein the fixed length stretches have the drive arrangements for engaging the driving elements and the variable length stretches do not have the drive arrangements for engaging the driving elements.

7. The handrail of claim 1, wherein all of the stretches are of fixed length and have the drive arrangements.

8. The handrail of claim 4, wherein each of the chain has chain elements which engage in the drive arrangements and the chain elements have a first width in the direction of movement of the handrail and, the drive arrangement of each fixed length stretch includes a first and a second consecutive valley of a tooth arrangement between three peaks or teeth, the valleys having a second width in the direction of movement greater than the diameter of the elements of the chains with which the valleys mesh.

9. The handrail of claim 5, wherein the stretches of variable length are elastically extendable, enabling lengthening by stretching or reduction by contraction dependent upon the force applied to the variable length stretches by the adjacent fixed length stretches.

10. The handrail of claim 4, wherein there are respective neighboring toothed wheels of adjacent successive chains and a common axle on which the neighboring toothed wheels are disposed, the neighboring toothed wheels of successive chains having different respective diameters and number of teeth, whereby the difference in diameter and number of teeth on the neighboring toothed wheels on a common axle determines a difference in speed of the respective successive chains.

11. The handrail of claim 10, wherein the successive chains run parallel and in respective close together planes.

12. The handrail of claim 10, wherein each chain has respective ones of the toothed wheels at the ends of a run of the chain and a same axle on which the toothed wheels of neighboring chains are mounted.

13. The handrail of claim 1, wherein the guides for the driving elements run inside the flexible belt or profile, at least in transition areas at the ends of the runs of each of the driving elements, each guide defining two parallel longitudinal paths in the direction of movement, a respective driving element circulates over each of the paths, and the transition between successive driving elements occurs at one of the guides; the drive arrangements of the fixed length stretches extend across both of the parallel longitudinal paths of the neighboring successive driving elements.

14. The handrail of claim 4, wherein each of the chains includes links and points of articulation between adjacent links of the chain and the chain includes chain elements which engage the respective drive arrangements of the fixed length stretches which are then in coincidence with the articulation points of the chain, the chain elements projecting perpendicular in opposing directions into each of the consecutive successive chains.

15. The handrail of claim 4, wherein each fixed length stretch has an internal profile that defines a double, parallel toothed arrangement which runs on interiors of the guides and each of the tooth arrangements is positioned to engage with one of the respective chains in the transition area.

16. The handrail of claim 1, further comprising pushing elements on the fixed length stretches, for producing speed variations of the stretches in the same direction as occurs in the guides.

17. The handrail of claim 12, further comprising pushing elements on the fixed length stretches, for producing speed variations of the stretches in the same direction as occurs in the guides; each of the pushing elements comprises a lever which acts on the fixed length stretch and a cam mounted on the common axle of two neighboring toothed wheels connected with the lever for moving the lever.

18. The handrail of claim 17, wherein the fixed length stretches have an end or lateral tooth engaged by the lever.

19. The handrail of claim 17, wherein the lever is articulated to a surface of a support of one of the tooth wheels; and a return spring acting on the lever against the action of the cam for returning the lever.

20. The handrail of claim 16, wherein the pushing element comprises a variable speed pinion positioned to act on a profile of the fixed length stretch.

21. The handrail of claim 7, further comprising a complementary profile on which the fixed length stretches slide in the forward moving direction, and the complementary profile serves as a support for the fixed length stretches.

22. The handrail of claim 21, wherein the complementary profile has a surface that is slotted and the fixed length stretches have ribs which are guided in the slots of the complementary profile.

23. The handrail of claim 21, wherein the complementary profile is shaped to hide the entrance slot of the fixed length stretches to the area over which the meshing chains circulate.

24. The handrail of claim 21, wherein there is an entrance slot for the handrail to the area over which the meshing chains circulate, and the entrance slot is covered with a rubber profile or brushes.

* * * * *